United States Patent [19]

Rimondi et al.

[11] Patent Number: 4,920,731

[45] Date of Patent: May 1, 1990

[54] MACHINE FOR PACKAGING PLURAL TYPES OF ARTICLES WITHIN A STRETCHABLE PLASTIC FILM

[75] Inventors: Renato Rimondi, Bologna; Angelo Cappi, Moderna, both of Italy

[73] Assignee: A.W.A.X. Progettazione E Ricerca S.r.l., Modena, Italy

[21] Appl. No.: 190,201

[22] Filed: May 4, 1988

[30] Foreign Application Priority Data

May 5, 1987 [IT] Italy ..... 20380 A/87

[51] Int. Cl.[5] ..... B65B 11/18

[52] U.S. Cl. ..... 53/556; 53/229; 53/232; 53/372

[58] Field of Search ..... 53/222, 226, 229, 232, 53/556, 586, 553, 372

[56] References Cited

U.S. PATENT DOCUMENTS

| | | | |
|---|---|---|---|
| 3,490,194 | 1/1970 | Monaghan | 53/372 X |
| 3,589,100 | 6/1971 | Konars | 53/372 X |
| 3,683,586 | 8/1972 | Duckhinsky | 53/228 |
| 3,777,452 | 12/1973 | Koenders | 53/556 X |
| 3,884,016 | 5/1975 | Bostrom | 53/229 X |
| 3,967,433 | 7/1976 | Benfiglioli | 53/228 X |
| 4,078,363 | 3/1978 | Ranzi | 53/228 |
| 4,137,691 | 2/1979 | Takahashi | 53/556 X |
| 4,143,463 | 11/1983 | Lancaster | 53/556 X |
| 4,279,116 | 7/1981 | James | 53/232 X |
| 4,548,024 | 10/1985 | Fine | 53/556 X |
| 4,573,305 | 3/1986 | Wildmoser | 53/556 X |
| 4,631,903 | 12/1986 | Takamura | 53/228 X |

FOREIGN PATENT DOCUMENTS

| | | | |
|---|---|---|---|
| 2422000 | 12/1974 | Fed. Rep. of Germany | 53/553 |
| 2410601 | 8/1975 | France | 53/556 |
| 1384450 | 2/1975 | United Kingdom | 53/229 |

*Primary Examiner*—John Sipos

*Attorney, Agent, or Firm*—Cohen, Pontani & Lieberman

[57] ABSTRACT

A machine for packaging plural types of products inside a plastic stretchable film, including a bundling unit and a complete sealing unit. The bundling unit includes a device for longitudinally stretching a film web segment before wrapping it around the articles, a device for wrapping the stretched and tensioned film around the periphery of the articles, as well as a sealing device adapted to join both ends of the film segment which has been stretched and tightly wrapped around the articles to be packaged. The complete sealing unit includes a device for transversely stretching the side edges of the film segment used for bundling, protruding out of the sides of the bundled articles, and a device for sealing closed the film wrapping around the bundled articles.

22 Claims, 7 Drawing Sheets

MACHINE FOR PACKAGING PLURAL TYPES OF ARTICLES WITHIN A STRETCHABLE PLASTIC FILM

This invention relates to the packaging of plural types of articles within a plastic film and it relates in particular to a machine for packaging a plurality of articles by means of a cold stretchable or semi-stretchable thermoplastic film material.

BACKGROUND

Some machines are already known for plastic film packaging of a plurality of articles such as cans, bottles, boxes and so on, either loose or collected on a tray. By means of said machines either a complete packaging of the articles is performed, i.e. with the plastic film wrapped around all the faces of the group of articles or container thereof, or a so-called bundling, i.e. wrapping the film around the peripheral faces of the group of articles, leaving two opposite faces unwrapped. Particularly for bundling, the known machines use a hot shrinking kind of plastic film, i.e. a type of film that shrinks when subjected to heating whereby the group of articles wrapped by the film get tightly enclosed. In order to obtain said shrinking, the film wrapped group of articles is passed through a heating tunnel which requires a larger floor area and a consumption of energy besides an environment temperature increase in the manufacturing rooms. The user of a heating tunnel causes even more drawbacks when the packaged products are likely to deteriorate if subjected to heat. Therefore, taking said drawbacks into account, attempts have been made to replace heat shrinking films with cold stretchable or partially cold stretchable films, i.e. those plastic material films which, after having been cold stretched exhibit the so-called "elastic memory" bringing them back substantially to the starting dimensions. While cold stretchable films have replaced the heat shrinking ones in the packaging of a large variety of articles,they have not been used yet for bundling operations, wherein heat shrinking films are still the preferred kind. The reason why they are still preferred should be sought in the fact that the machines used up to now for cold stretchable film packaging lack the ability to uniformly stretch the film in the longitudinal direction, that is in such a way as to avoid sideways shrinking. In fact, it is already known that when a film web gets longitudinally stretched, it tends to shrink transverse to the stretching direction, the shrinking effect reaching its maximum in an area half way between the end portions being clamped by the stretching means. Therefore, if a film web having the same width as a container were used for bundling said container, after stretching the container side contacting the central shrunk area of the film would not be completely covered by the same, whereby the bundling would be substantially ineffective. If attempts were made to correct said drawback by increasing the film transverse dimensions in order to compensate for strech dependent transverse shrinking, a problem would still arise at the end portions of the films in that the film would hang out of the corners of the bundled container, whereby bundling uniformity would be lost and film would be unavoidably wasted.

SUMMARY OF THE INVENTION

This invention has a main object to provide a machine for bundling plural types of articles, either loose or collected on a tray or inside a container, by means of a cold stretchable or semi-stretchable kind of film. A further object of this invention is to provide a machine adapted to both purposes of bundling a plurality of articles by means of a cold stretchable or semi-stretchable film, and of completely packaging said articles by means of the same kind of film. These and other objects are achieved, according to the invention, by means of a machine including a device adapted to uniformly stretch the film in a longitudinal direction while shrinking of the central region thereof is avoided, to peripherally wrap the film around the plurality of articles to be bundled while the film is kept in a tensioned condition, and eventually to seal together both film ends while the film is still tensioned, i.e. before the film shrinks back due to its elastic memory. In addition, the machine according to this invention includes further supplementary and complementary devices which will be described in detail in the following, referring to the attached drawings, wherein:

DESCRIPTION OF THE PREFERRED EMBODIMENT

Figure 1:
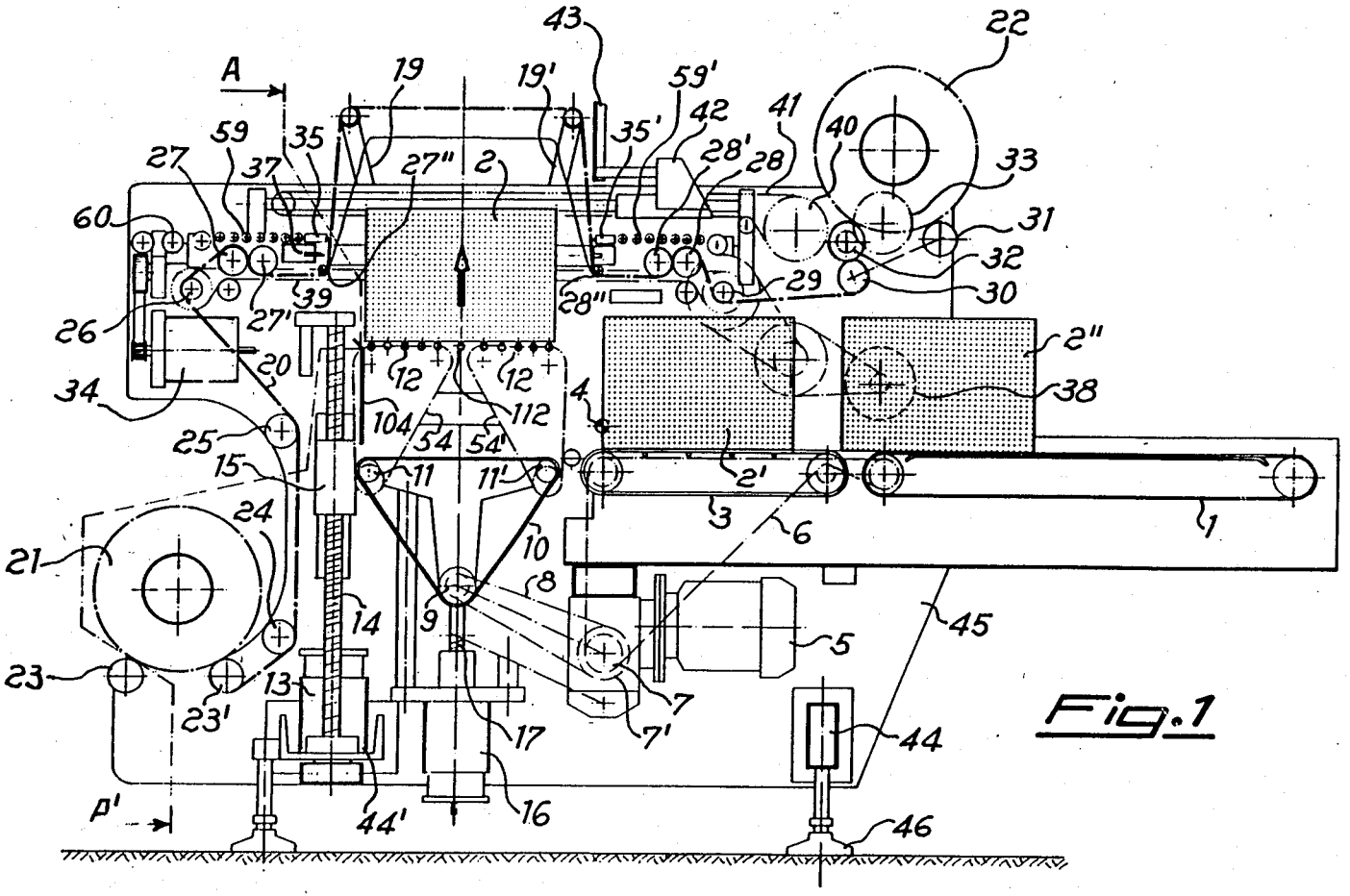
FIG. 1 shows a side elevational view of an embodiment of the bundling machine according to this invention.

Referring now to FIG. 1 there is shown a belt conveyor 1 feeding containers 2, 2′, 2″ and so on, to be packaged, each container holding a plurality of articles, and a second conveyor belt 3 moving forward at a higher speed compared to conveyor belt 1. The speed difference causes container 2 to move apart from container 2′ which follows, whereby around container 2 there is provided the unobstructed room necessary for packaging thereof. A suitable separating distance between various containers is guaranteed also by photoelectric cell 4 whose task is to stop container 2′ when it gets to the point controlled by the photoelectric cell, anticipating the machine cycle. As soon as container 2′ gets into the path of photoelectric cell 4, the latter stops conveyor belt 3 whereby container 2′ remains in said position until the moment when conveyor belt 3 is started again by the machine lifting group, as will be described in the following. Underneath conveyor belts 1 and 3 there is provided motor 5 which sets them in motion by means of chain 6, driven by sprocket 7 of motor 5. Said motor 5, by means of sprocket 7′ coaxial with sprocket 7, drives a further chain 8 which in turn drives pulley 9, whereby paired belts 10 and 10′ (the latter of which is not shown) are driven around idle rollers 11 and 11'.

Belts 10 in turn, when coming into contact with small diameter idle rollers 12 frictionally rotate the latter in the same direction as the motion of belts 1 and 3, whereby containers 2 can be transferred from belt 3 to the machine lifting device wherein small diameter rollers 12 perform as a support table for containers 2. Rotation of small diameter rollers 12 makes container 2, arriving from conveyor belt 3, to proceed further up to a stop wall 104 where a sensor is mounted having the task to enable the lifting device for operation as soon as it is contacted by container 2. The position of stop wall 104 is adjustable according to the longitudinal dimension of container 2, whereby said container is just at the center of the support table when the sensor mounted on said wall is triggered.

The support table comprised of small diameter rollers 12 is able to move in a vertical direction in that it is a part of the lifting device of the machine, including a motor 13 adapted, through pulleys 48 and 49, and through cogged belt 47 (visible in FIG. 2), to subject lead screw 14 to an axial rotation whereby nut screw 14', of a recirculating ball type (which can be seen in FIG. 2 as well) is made to move up or down according to the direction of rotation of motor 13. Nut screw 14' is fastened to a cross member 15 whose ends bear two brackets rigidly fastened thereon, each bracket supporting a pair of hollow pin chains 54, 54'' and 54', 54''' respectively, which chains are free to rotate around idle sprockets (not shown in FIG. 1). Small diameter rollers 12 which are supported by hollow pins belonging to said chain and rotate during the loading step of container 2 to be packaged, stop rotating during the container 2 lifting step, since they are no longer in contact with belts 10. During upward motion of the lifting device, the plurality of small diameter rollers 12 acts merely as a support table for container 2.

The vertical motion of the lifting device is guided by upright posts 50, 50' (shown in FIG. 2) whereupon there is slidably mounted two sleeves 51 and 51' (shown in FIG. 2 as well) integral with cross member 15. Motor 13 is controlled by a known programmable electronic apparatus (neither shown nor described, being known) which sets the speed thereof as well as the acceleration and deceleration curves.

Film 20 unrolls from lower roll 21 moving upwards and is rewound around an upper roll 22. The upward motion of film 20 starting from lower roll 21, is guided by idle rollers 24, 25, 26 wherefrom the film gets into the stretching device including two pairs of rubber lined rollers 27, 27' and 28, 28' both driven by motor 34 which rotates both rollers of each pair in opposite directions in order to stretch and subsequently keep in tension the span of film 20 lying between said rubber lined rollers. Motor 34 is controlled by a known type electronic apparatus (now shown) whose task is to continuously control the longitudinal tension in the span of film 20 lying between said pairs of rollers, both as a function of the properties of the film and of the shape or properties of the container 2 or of products to be packaged.

Between rubber lined idle rollers 27', 28' moving opposite to rubber lined rollers 27, 28 which are driven by motor 34, there is preferably provided a pair of idle rollers 27'', 28'' for a better guiding action upon film 20. The pairs of rollers 27, 27' and 28, 28' are preferably driven by a single motor, in order to avoid a possible lack of symmetry in the wrapping of the film around the container. In fact, it is of paramount importance that the draught performed by a pair of rollers on film 20 is absolutely equal to the draught of the other pair of rollers. If the draught force applied by one pair of rollers were lower than that applied by the second pair, the film segment would be dragged towards said second pair. The provision that both pairs of rollers be driven by the same motor avoids any possible imbalance and guarantees perfect symmetry both in film stretching and in film wrapping.

The tension force applied by the pairs of rollers 27, 27' and 28, 28' must be higher than the tensile strength of film 20, the difference in strength being enough to cause film stretching. Said stretching is the necessary condition to generate the so-called elastic memory in the film before the latter is wrapped around the articles to be packaged. It will just be because of said elastic memory that the film, after having been wrapped around the articles to be packaged, will enclose them tightly whereby a perfect bundling action is guaranteed. Once the stretching of the span of film 20 has been performed, the two pairs of rollers 27, 27' and 28, 28' can no longer rotate since the tension force they apply on the end of film span 20 is balanced by the tensile strength of the stretched film. Nevertheless, if the film is pulled, for instance because it has been pushed upwards by the articles to be packed raised by the lifting device, the draught applied to the film by said articles makes the film to rotate both pairs of rollers 27, 27' and 28, 28' in the opposite direction, whereby the span of film 20 included between the pairs of rollers becomes longer without any further stretching arising in the film.

During said stretching the span of film 20 is constantly kept under tension by the pairs of rollers 27, 27' and 28, 28', whereby the film applies a certain compression upon the articles to be bundled. When the latter do not yield, said compression is balanced by the stiffness of said articles, whereby they do not undergo any deformation during the bundling operation. For those cases where on the contrary said articles are not sufficiently stiff to resist a deformation thereof under the compression applied by film 20, stretched and kept under tension, the inventive machine is provided with members adapted to overcome said problem, in the form of tension means 19, 19' whose arrangement and function will be described in detail in the following.

The function of tension means 19, 19' is to keep under tension the span of film 20 that has been stretched by the pairs of rollers 27, 27' and 28, 28' and they perform their task replacing the articles to be bundled. At the upper end thereof, said tension means bear a horizontally extending arm having a length shorter than the width of the packaging film, but equal to or slightly greater than the width of containers 2 to be packaged.

The distance separating said horizontal arms of tension means 19, 19' is larger than the length of container 2 to be packaged and it corresponds approximately to the length of the span of film 20 which has been stretched by the stretching device. At the lower end thereof, tension means 19, 19' bear a sloping arm and said sloping arms are both made integral with a nut screw 18 of the ball recirculation type (shown in FIG. 2), which is made to move up or down by the rotation of lead screw 17 driven by motor 16. The latter motor, which is controlled as well by an electronic control system similar to the one controlling motor 13 of the lifting arrangement, by rotating in either direction causes raising or lowering of nut screw 18 and of tension means 19, 19' integral therewith.

The upward motion of said tension means 19, 19' is controlled by the same sensor which starts the raising step of the machine once it has been triggered by container 2 having reached contact with wall 104. During their upward motion tension means 19, 19' come into contact with the span of film 20 lying between the pairs of rollers 27, 27' and 28, 28', said span having already been stretched by said rollers which are continuously keeping it tensioned. The compressive force applied by said stretched film segment is supported by the horizontal arms of tension means 19, 19', whereby they protect container 2 to be packaged. While they keep moving along their upward stroke, tension means 19, 19' cause stretching of the film segment lying between said pairs of rollers 27, 27' and 28, 28' until they make it to reach a length slightly longer than the girth of container 2 to be bundled. Once they have reached the end of their upward stroke, tension means 19, 19' change their direction of motion to come down to the idle position thereof, while the lifting device is still raising container 2 to be bundled. In this way, the upper face of container 2 comes into contact with the central area of the segment of film 20, an area that has already been stretched by the stretching device and which is lying between the horizontal arms of tension means 19, 19'. The film segment is then symmetrically wrapped around container 2, relative to the upper surface center line, until the point where both ends of the film segment join each other at the center line of container 2 bottom face. With this provision, the film transverse shrinking is done away with, where otherwise said shrinking would have been generated if a segment of film 20 having a length equal to the girth of container 2 to be bundled had been subjected to longitudinal stretching in a single operation.

As already mentioned above, when container 2 or the products to be bundled have a sufficient compressive strength, stretchers 19, 19' and the whole arrangement to which they belong can be omitted, since the function thereof is taken directly by the container or by the products to be bundled.

The film stretching device included in the machine according to this invention is associated with a wrapping device adapted to wrap film 20 around container 2 or directly around the products to be bundled. Said device, which will be described in detail in the following, includes motor 38, which is still controlled by an electronic control system of a known type and therefore not described herein, which sets velocities, accelerations and idle times thereof. Motor 38 rotatingly drives, by means of a gear train, a pair of horizontal cogged belts 39, parallel to each other. Two frames (not shown) are connected, with the appropriate phase, the first one to the upper horizontal run and the second one to the lower horizontal run respectively of the cogged belts 39, said frames being adapted to move horizontally closer to each other, or apart from each other, in a symmetrical position relative to the center line of the support plane comprised of the plurality of small diameter rollers 12. On one of said frames, also bearing the pair of rubber lined rollers 27, 27' already described above, together with the corresponding idle roller 27'' there is mounted a folding device 35 as well as the group of idle rollers 59 associated with said folding device, and the sealing device 36. On the second frame, besides said second pair of rollers 28, 28' together with corresponding idle roller 28'' there is mounted a folding device 35' associated with the group of idle rollers 59', and the sealing device 37. Sealing device 36, located immediately below folding device 35, is provided with two mutually parallel flat strap electric resistances located one above the other, for electric impulse sealing of film 20. Between the two sealing straps there is provided a blade 61 for transversely severing the film. Opposite from sealing device 36 there is provided the second sealing device 37, which is as well provided with two mutually parallel flat metal strap electric resistances located one above the other, like those of sealing device 36. In this case though, between the flat straps and sealing device 37 there is provided a slot 62 wherein blade 61 is received after the latter has crossed and severed film 20. Sealing devices 36, 37 are internally hollow in order to receive a flow of compressed air which, by means of small nozzles (not shown) located close to the sealing bands, provides a cooling action for the whole length of the sealing bead.

After having moved through the stretching, wrapping and sealing devices, film 20 is again wound around roll 22 which is supported by idle roller 31 and by rubber lined roller 32, the latter being driven by motor 33 whereby it rotates roll 22 and performs winding of film 20 therearound. Near upper roll 22 there is located electric motor 40 operative to drive, by means of cogged belt 41, the back and forth strokes of slide 42 bearing ejecting platform 43. Said platform is provided in order to eject container 2 from the machine, once the packaging thereof has been completed.

The whole of the machine parts bear upon transverse beams 44 and 44', cooperating with machine body 45 and bearing upon four supporting feet 46, 46', 46'', 46'''.

Figure 2:
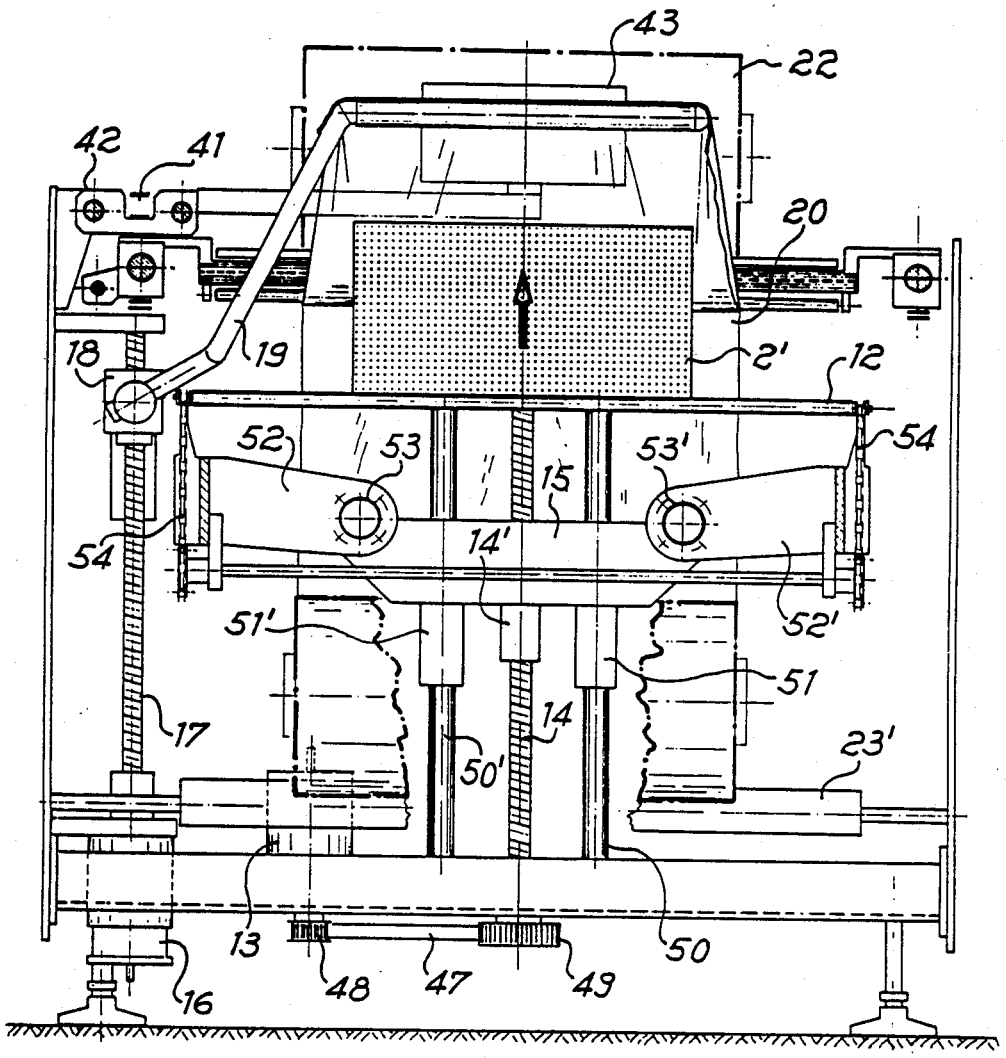
FIG. 2 is a front elevational section view taken along line A—A′ of FIG. 1.

Referring now to FIG. 2 there is shown, in more detail, motor 16 which by means of lead screw 17 drives the up and down motion of recirculating ball nut screw 18 to which tension means 19 is fastened. Tension means 19, like corresponding tension means 19', is preferably comprised of metal tubing including three sections, each forming a different angle to the horizontal. The lowest part, which is the one fastened to nut screw 18, does not have as steep a slope as the intermediate portion which turns, at the opposite end thereof, into a horizontal part. As it can be seen in FIG. 2, said horizontal arm is slightly longer than the width of container 2 to be packaged whereby it leans just a little out, beyond the sides of said container. The horizontal arms of the two tension means 19, 19', when nut screw 18 is pushed upwards by the rotation of lead screw 17, come to engage the segment of film 20 and they keep under tension the central area thereof. The further rising of tension means 19, 19' causes a temporary increase in film tension, which overcomes the tension applied to the ends of the segment of film 20 and makes the pairs of rollers 27, 27' and 28, 28' to rotate in an opposite direction in order to allow said segment to increase in length without stretching.

In FIG. 2 there is also shown motor 13 which drives lead screw 14 for a ball recirculation type nut screw, through cogged belt 47 running between pulleys 48 and 49. Rotation of the lead screw 14 in one direction or the other causes cross member 15 associated with the plurality of small diameter rollers 12 to rise or to lower. Vertical strokes of cross member 15, driven by lead screw 14, are guided by vertical posts 50 and 50' which slidingly receive sleeves 51 and 51' integral with cross member 15. Cross member 15 is further provided with brackets 52 and 52' which are pivoted to cross member 15 at 53 and 53' and control the raising and lowering strokes of the support plane comprised of the plurality of rollers 12. In the upper part of FIG. 2 there can be seen ejecting platform 43 which is controlled by slide 42, whose motion is in turn controlled by belt 41 driven by motor 40 (not shown).

Figure 3:
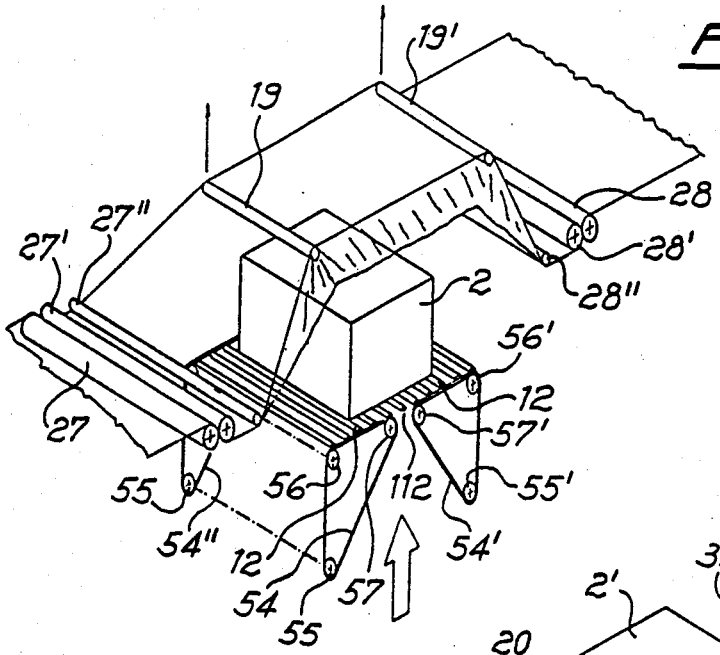
FIGS. 3 to 6 show perspective detailed views of the film stretching and wrapping devices, together with a product supporting table, included in the machine of FIG. 1, during the bundling operation of a container.
Figure 4:
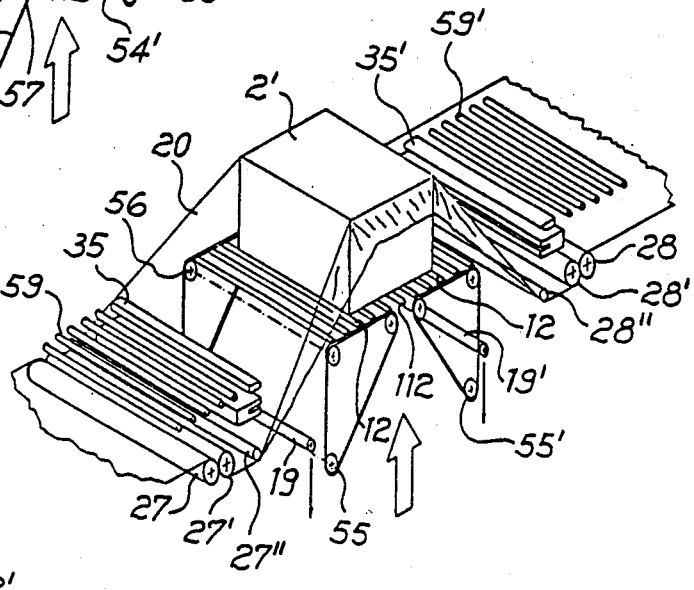

Operation of the bundling machine according to this invention will now be described referring to FIGS. 3 to 8 which show some of the typical steps of said operation. In FIG. 3 there is shown the moment when container 2, having triggered the sensor located on stop wall 104 (not shown in this Figure), has caused tension means 19, 19' to move upwards, together with the lifting arrangement whose upper part carries the support platform defined by the plurality of small diameter rollers 12, on top of which container 2 is lying. The upward motion of tension means 19, 19', besides keeping the central area of the segment of film 20 under tension, causes an elongation of the same since the ends of said segment are no longer retained between the pairs of rollers 27, 27' and 28, 28' of the film stretching device. In the example shown in the Figure, the horizontal arms of tension means 19, 19' are shorter than the film width, whereby the sides of the central area of the tensioned film are terminated with two non tensioned bands, which therefore are left in a relaxed condition. Said bands are normally not required for bundling, but they are essential in those cases where, as will be described in the following, after bundling it is desired to perform complete packaging of container 2, around all sides thereof. In FIG. 3 there is shown in detail the plurality of small diameter rollers 12 forming the support surface for container 2, said plurality of rollers being divided in two equal halves. The ends of rollers 12 belonging to the half series on the left hand side are supported idle by the hollow pins of the two parallel chains 54 and 54'', while the ends of the rollers belonging to the half series on the right hand side are supported idle by the hollow pins of the two chains 54' and 54'''. Both chains 54 and 54'' are free to turn around idle sprockets 55, 56 and 57, while both chains 54' and 54''' are free to turn around idle sprockets 55', 56' and 57'. Idle sprockets 55, 56 and 57 are located at the corners of an imaginary inverted triangle (whose base is defined by the positions of sprockets 56 and 57). Idle sprockets 55', 56' and 57' are similarly arranged. The left hand side half series of small diameter rollers 12 forms half of container 2 support platform, when the latter is located on the plane defined by the corresponding triangle base, i.e. on the span included between sprockets 56 and 57. The right hand side half of the series of small diameter rollers 12 has the same arrangement when included between sprockets 56' and 57'. In the particular embodiment shown in the drawing, the imaginary triangles whose corners are defined by the positions of idle sprockets 55, 56 and 57, as well as 55', 56' and 57', are mirror-image right-angled triangles whose hypotenuses are defined by sprockets 55, 57 and 55', 57', respectively. Between the two half series of small diameter rollers 12 there is provided a further small diameter roller 112 substantially identical to rollers 12 whose ends are not mounted on any of said chains 54, 54', 54'' and 54''', and having a function described in the following. FIG. 4 shows in detail the moment when the lifting arrangement has ended its upward stroke carrying the plane defined by small diameter rollers 12 to the same level as the folding devices 35, 35' and of respective associated pluralities of rollers 59, 59' of the wrapping device which have been stationary for the whole period when the lifting arrangement has performed its upwards stroke. At the end of said stroke, motor 38 drives the mutual approaching of the two frames carrying folding devices 35, 35' which, at a certain point, come into engagement respectively with the outermost small diameter roller 12 of the left hand side half series of rollers, and with the outermost small diameter roller 12 of the right hand side half series of rollers, urging them with a force directed towards center roller 112.

Figure 5:
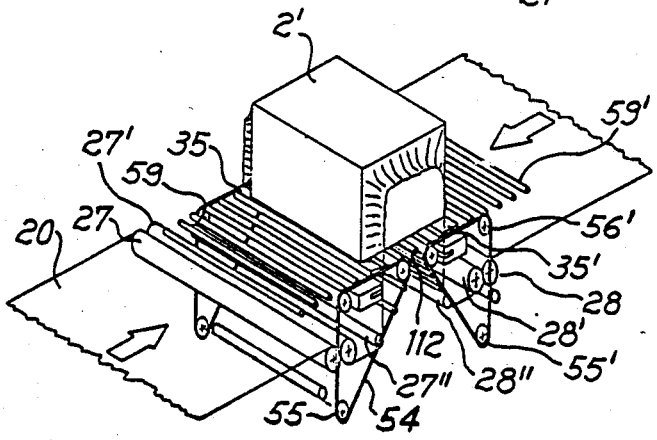

As shown in the following FIG. 5, innermost rollers 12, i.e. the rollers closest to the central roller 112, being urged by folding devices 35, 36, are moved downwards due to the rotation of pairs of chains 54, 54'' and 54', 54'''. While continuing their mutual approaching motion, the two folding devices gradually push towards the center of the support plane all the small diameter rollers 12 of both series, which move downwards and are gradually replaced by the groups of idle rollers 59, 59' which follow the folding devices 35, 35'. Central small diameter roller 112 whose ends are connected to brackets 52, 52' of the lifting arrangement, will be the last roller to continue supporting container 2 at the center line thereof, when all the other rollers have disappeared downwards. The small diameter roller 112 as well will disappear in turn in the downwards direction, dragged by the lifting arrangement during the downward return stroke thereof, just before the two folding devices 35, 35' come into contact with each other in the position taken until then by small diameter roller 112.

Figure 6:
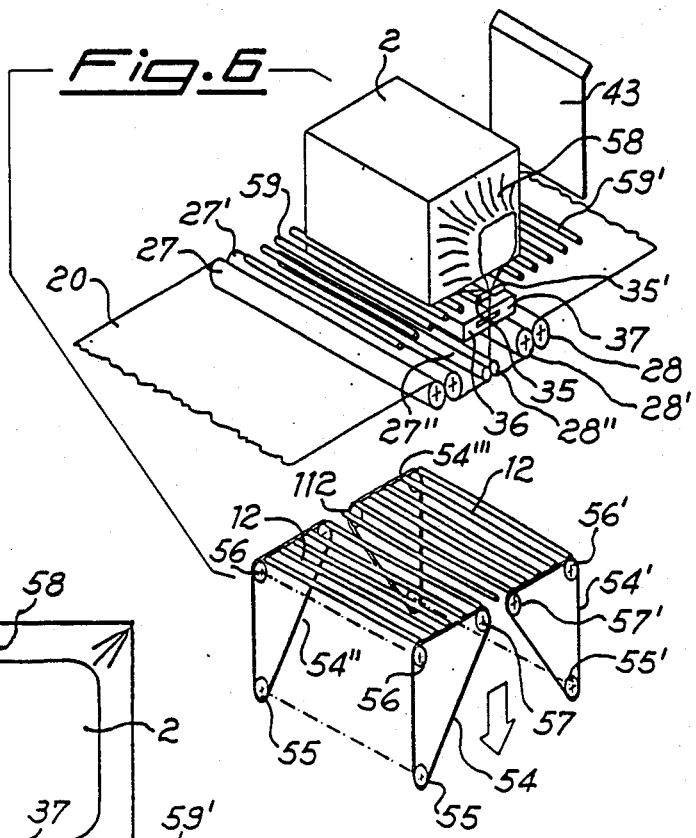

During the downward stroke of the lifting arrangement, the small diameter rollers 12 in the innermost positions of the right hand side half series and of the left hand side half series, which at that time will be located on the "hypotenuses" of said imaginary triangles (i.e. on the sides included between sprockets 55, 57 and 55', 57') engage against the stationary abutments (not shown) which make chain pairs 54, 54'' and 54', 54''' to change their direction of motion relative to the one they had previously taken under the action of folding devices 35, 35'. In this way, as the lifting arrangement gradually moves downward, all of the small diameter rollers of both halves are pushed upward and carried again to form the new horizontal support plane adapted to receive and lift container 2. FIG. 6 shows the moment when, while small diameter rollers 12 have formed again the horizontal support plane, folding devices 35, 35' have come into contact after having wrapped film 20 around container 2.

The ends of the segment of film 20 are tightly clamped by the two folding devices 35, 35', whereby film 20 keeps being held under tension. This has been made possible by the gradual replacement of small diameter rollers 12 of the lifting arrangement with the groups of rollers 59, 59' of the folding arrangement, underneath the lower surface of container 2. This is a very important feature of this invention, and that is apparent if one considers that, if the support plane of the group were not a hideaway type, it would allow the rollers of the wrapping group to wrap the film on three faces only of container 2, the fourth face being actually obstructed by the support plane. It should be noted that, while folding devices 35, 35' move closer to each other, a mutually approaching motion also takes place between the two pairs of rollers 27, 27' and 28, 28' which are mounted on said two frames carrying folding devices 35, 35' and are driven by motor 38 through cogged belts 39.

Both pairs of rollers 27, 27' and 28, 28' which, as it has already been described above, continue to keep under tension the segment of film 20 after they have stretched the same, are made to change the direction of rotation, (relative to the direction which caused the stretching) while the segment of film 20 is elongated by the lifting of the articles to be bundled or by the tension means 19 and 19'. In fact, while said lifting takes place, both pairs of rollers rotate in such a way as to assist the film segment elongation, i.e. to feed the film web towards the central area of said segment.

Thereafter, due to a mutual approaching, the two pairs of rollers 27, 27' and 28, 28' change their direction of rotation two more times. The first time is when tension means 19 and 19' change their direction of motion to come back to the idle position thereof, and a second time is when said tension means, during their own motion, get to the position vertically above the sides of container 2 to be bundled. After the first of these two additional changes in rotational direction the pairs of rollers 27, 27' and 28, 28' keep the new rotational direction thereof until folding devices 35, 35' get to a position vertically above the sides of containers 2 to be bundled. For that entire length of time, said pairs of rollers in order to keep under tension the segment of film 20 included therebetween, must rotate in the opposite direction, since said segment of film 20 should no longer elongate, but it should instead shorten according to the mutual approaching action of folding devices 35, 36. Instead, after the second of said further changes in the rotating direction thereof, the pair of rollers 27, 27' and 28, 28', in order to keep under tension the segment of film 20 included therebetween, should assist the elongation thereof, or in other words they should assist the film segment to go back to its starting length.

Therefore, during an entire operating cycle, the two pairs of rollers 27, 27' and 28, 28' rotate first in one direction to cause longitudinal stretching of the film segment, then they stay stationary in a condition of dynamic balance when the film segment has reached the desired degree of stretching, then they change direction of rotation in order to assist the film segment in elongating under the action of tension means 19, 19', and following that they change direction of rotation once more in order to re-wind the film for the whole period of time spanning from the moment when the tension means 19, 19' change their direction of motion to the moment when folding devices 35 and 36 come to a position on the vertical of the sides of containers 2, and eventually they change their rotational direction one last time to allow folding devices 35 and 36 to complete wrapping the film.

During the whole cycle of operations the film segment is continuously kept under the desired tension, which is relieved, as it will be described in the following, only during the sealing step just in order to allow the sealing seam to set. In the following the film end sealing will be described in detail, reference being made to FIGS. 7 to 10.

Figure 7:
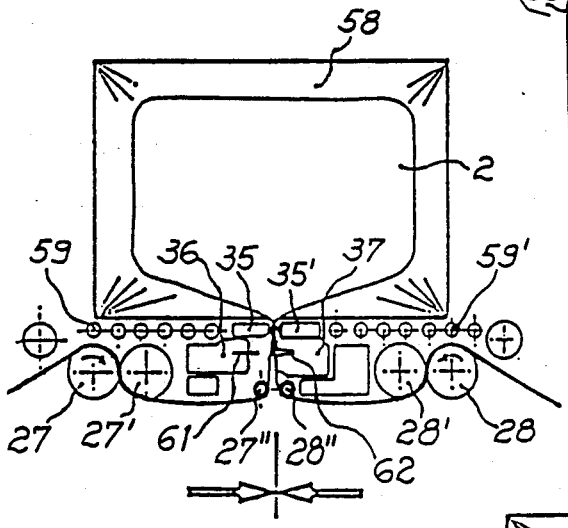
FIGS. 7 to 9 show side elevational details of the film wrapping and sealing devices, during the bundling machine operation.

In FIG. 7 there is shown how the two folding devices 35, 35', after having expelled all the small diameter rollers 12 from the area underlying the lower face of container 2, have come into mutual engagement and perform now as pliers to clamp film 20 and still keep it under tension after having formed with the latter a peripheral wrapping around container 2. At this stage, motor driven rollers 27 and 28 which in cooperation with respective counteracting rollers 27' and 28' have continuously kept film 20 under controlled tension, change their rotational direction (as it is shown by the small arrows in the drawing) whereby the film tension is slackened. The film though, being clamped by folding devices 35, 35', cannot relax ahead of a position a little downstream from said folding devices. At this moment film 20 is into engagement with sealing device 37 located underneath folding device 35', while sealing device 36 together with blade 61 thereof located underneath folding device 35, are still far apart from film 20.

Figure 8:
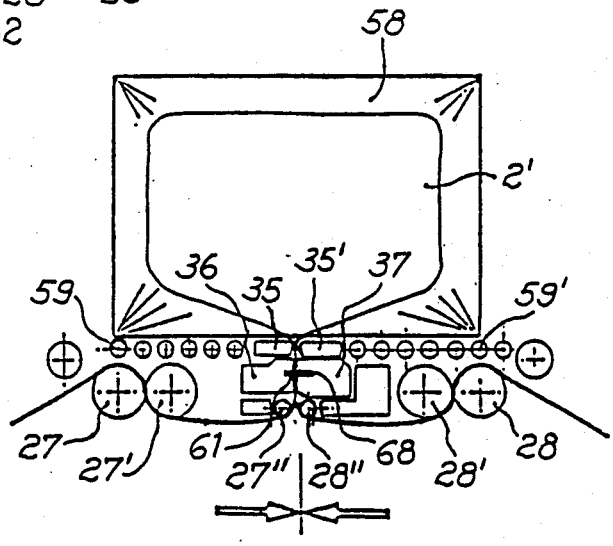

FIG. 8 shows the moment when also sealing device 36 has come into engagement with film 20, whereby the metal strap resistances thereof receive, similarly to those of sealing device 37, a heating current pulse which causes sealing of the two film flaps lying between said metal strap resistances. Simultaneously, blade 61 has severed film 20 along the sealing seam center line and has cut through to cavity 62 of sealing device 37. The sealing seam in this way is longitudinally severed generating two parts one of which will be left on the wrapping, around bundled container 2, while the second part remains on film web 20. At this stage, while folding devices 35, 35' are still tensioning the film in the area above the sealing seam, the latter is cooled down by the compressed air flowing out of the small nozzles (not shown in the drawing) located near the resistances of the two welding devices 36, 37 which have now begun moving apart from each other.

Figure 9:
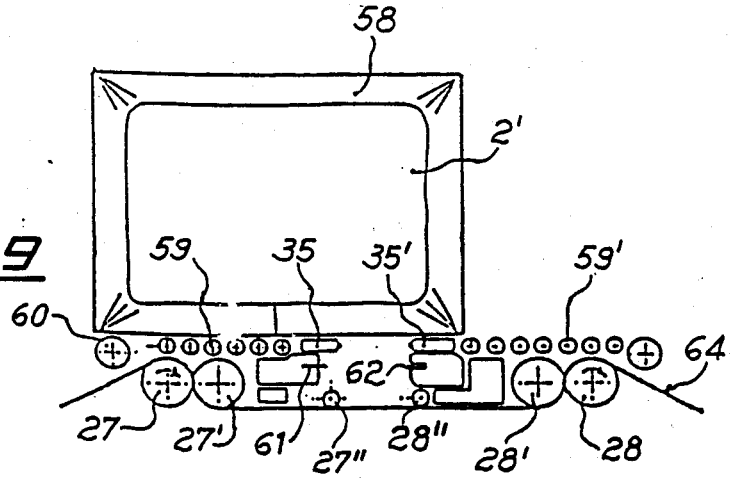

In FIG. 9 there is shown the stage where also folding devices 35, 35' together with respective roller platforms 59, 59' have started moving apart from each other, releasing wrapped container 2 which, under the action of ejecting plate 43 (not shown) is pushed from roller platform 59 to roller platform 60. It should be noted that the outer longitudinal edge of the segment of film 20 which has been subjected neither to the pre-stretching by tension devices 19, 19', nor to controlled stretching by folding devices 35, 35', has created on the face of container 2 which was left unwrapped, a sort of crown 58. As was already mentioned hereinabove, said crown 58 is not essential in case of bundling a plurality of loose articles or the container thereof, therefore in such a case the dimensions thereof are kept to a minimum. On the contrary, said crown is necessary when a complete wrapping of the articles or container thereof is performed, as will be described hereinafter, in which case the crown dimensions are suitably larger.

Shown in FIG. 9 is also the fact that motor driven rollers 27, 28, being no longer controlled by motor 34, rotate in the same direction (as shown by the small arrows in the drawing) whereby a predetermined length of film 20 can be wound around roll 22 (rotated by motor 32), so that sealing bead 64 is displaced from the central position, wherein it has been formed, towards the right, reaching a predetermined position (shown in FIG. 9). The amplitude of said displacement is a function of the position wherein it is desired the sealing seam to appear on the faces of the next container 2' which will be bundled in sequence after container 2. If sealing seam 64 is left in the central position, wherein it has been formed when sealing the film around container 2, it will appear on the center line of the top face of next container 2' whereby the latter will carry two sealing seams. If on the contrary sealing seam 64 is moved towards the right a distance slightly greater than half the length of film 20 that has been necessary to bundle container 2', the sealing seam will be left on the length of film wound around upper roll 22 and will not appear on container 2' which in this case will carry only one sealing seam on the bottom face thereof. Obviously, for shorter displacements, sealing seam 64 will show up on next package 2' in predetermined positions intermediate the top face center line and the bottom face center line. This is an important new feature of this invention, in that it makes it possible to provide packaged containers whereon only one film sealing seam can be seen, located at the container bottom side center line, or else two sealing seams wherein the first one is located at the container bottom side center line, while the second is located in any arbitrarily selected position, intermediate said first sealing seam and a position diametrically opposite thereto. As it is understood there are various reasons why it is preferable to have a single sealing seam on the container, but this implies a certain waste of film. In those case where film consumption has to be reduced, it is necessary to accept the presence of a second sealing seam on the final package, and in such a case it is preferred, at least for appearance reasons, that said seam be located on the packaged bottom face. In any case, this novel inventive feature allows a choice to be made any time a prevailing role is to be given to package appearance or to cost reduction.

In the exemplary case herein, container 2 needs not only to be submitted to a simple bundling, but to a complete packaging. Therefore, it is not unloaded from the machine, but it is transferred to a second unit in the same machine wherein, using the film side crowns 58 provided on purpose on the unwrapped faces of bundled container 2, it actually proceeds to the total packaging of container 2 by means of film 20. Said unit will be described in detail in the following, reference being made to the Figures mentioned herein.

Figure 10:
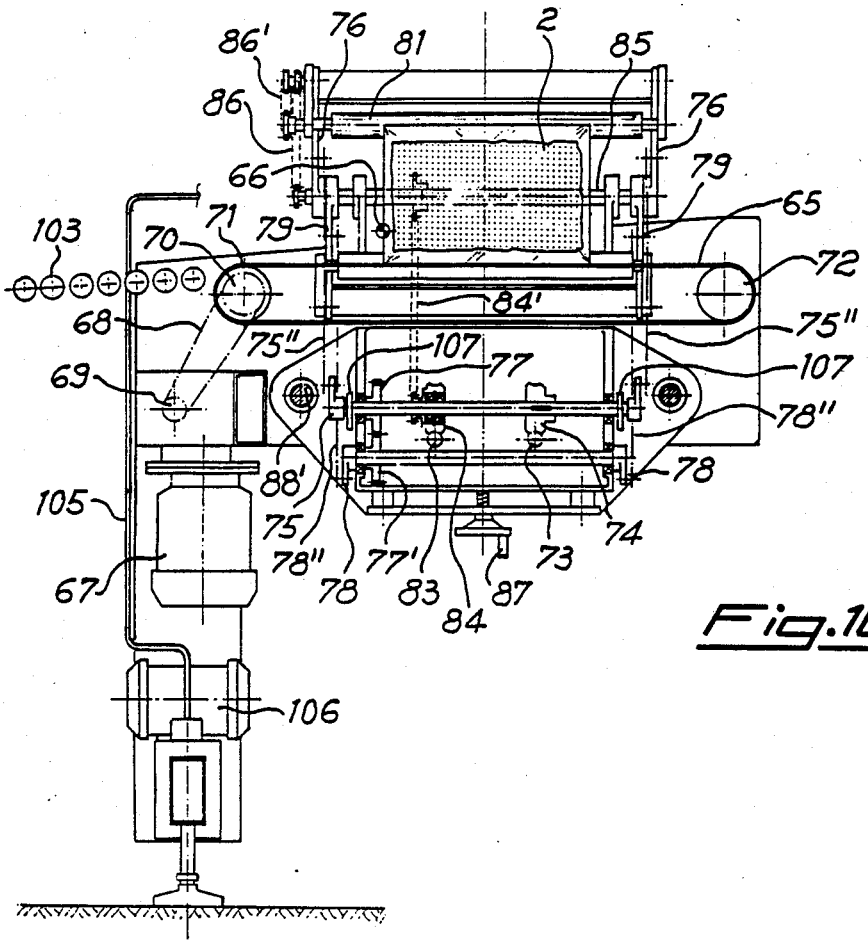
FIG. 10 shows a side elevational view of the second unit of the inventive machine, wherein complete packaging is performed.
Figure 11:
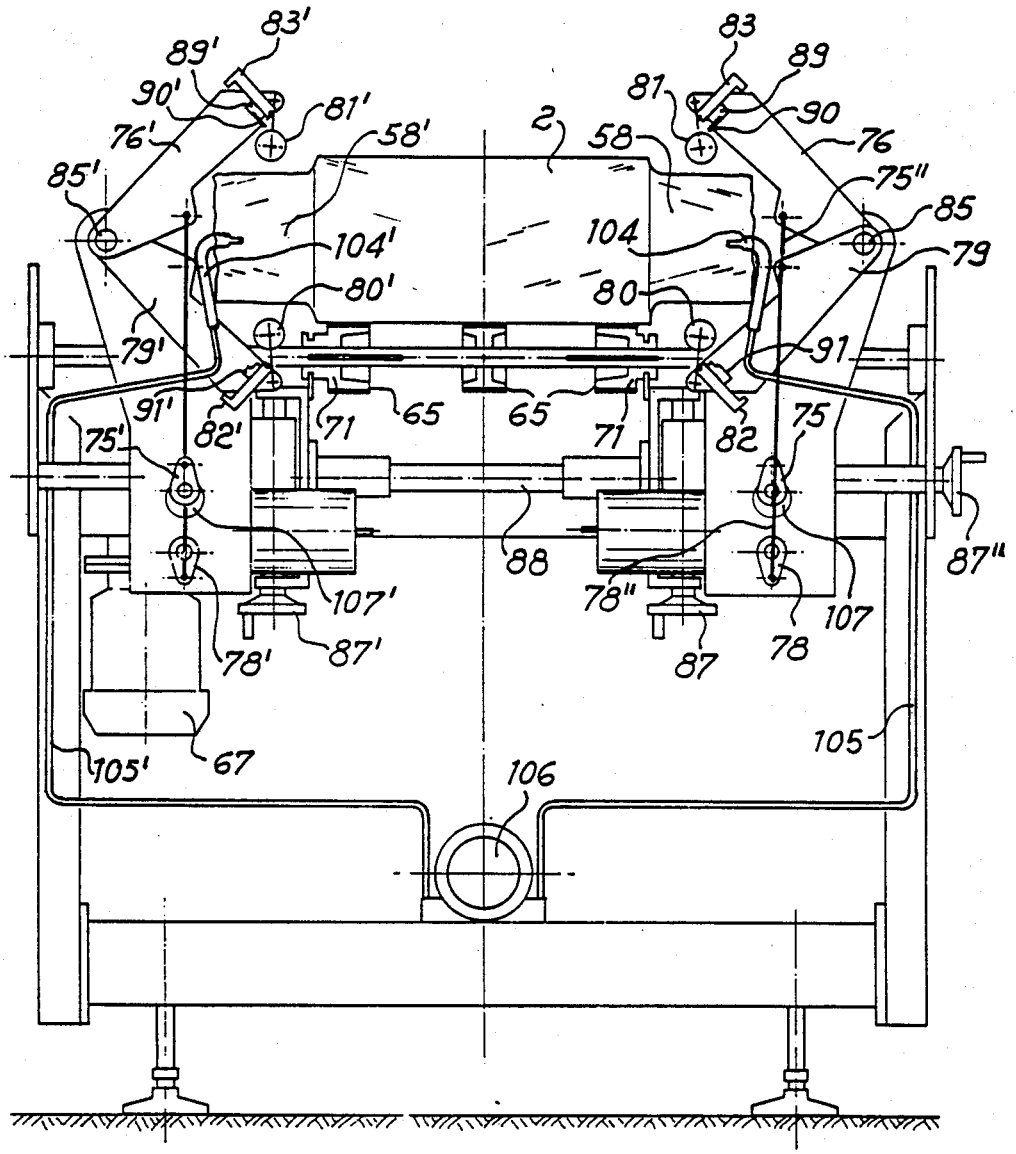
FIG. 11 shows a front elevational view of the second unit, already shown in FIG. 10.

In FIG. 10, which shows a side elevational view of said second unit, container 2 rests on conveyor belt 65 whereon it has been pushed by ejection platform 43 when said container was still lying on rollers 60 at the first machine station. Conveyor belt 65 is comprised of three parallel belts (as is best shown in FIG. 11) being driven by motor 67 by means of sprockets 69, 70, chain 68 and pulleys 71, 72. Conveyor belt 65 carries container 2 inside the machine until the moment when photoelectric cell 66, being fixed in position for any length of container 2, is blinded thereby and stops belt 65. Therefore tubular crowns 58, 58' of container 2 have come inside an area included between two tongs comprised of the pairs of levers 76, 79 and 76', 79' pivoted at 85 and 85' respectively, which support pairs of rollers 80, 81 and 80', 81' respectively, at the ends thereof. Rollers 80 and 80' are idle rollers while rollers 81, 81' are driven by two motors (not shown). When said tongs close like jaws, idle rollers 80, 80' are brought into engagement with motor driven 81, 81' respectively, and tubular crowns 58, 58', caught therebetween, are transversely stretched in that said idle rollers 80, 80' are dragged to rotate in a direction opposite to motor driven rollers 81, 81'.

The jaws-like closing motion of pairs of levers 76, 79 and 76', 79' is driven by two motors (now shown), one for each jaw, controlled by an electronic control system which determines position and phase thereof. Operation of upper lever 76 is controlled by worm screw 73, worm gear 74, cams 75 and rods 75', while for lower lever 79 it is driven through transmission gears 77, 77', cams 78 and rods 78'. Operation of tongs comprised of levers 76', 79' is driven by means of a similar structure.

Also the two motors, one for each tongs, driving motor-operated rollers 81, 81', are controlled by an electronic apparatus which determines the torque thereof (and therefore the roller stretching power) depending upon the film elastic properties and upon container 2 properties. Rotation is transmitted by the motor to roller 81 through worm screw 83, worm gear 84 and chains 84', 86 and 86'. Roller 81' is driven through a similar structure.

As is shown in FIG. 11, vertical adjustment of tongs 76, 79 and 76', 79' which is provided in order to continuously keep the tongs centerline at the centerline of the container 2 vertical sides, takes place through a lead screw-nut screw arrangement (not shown) actuated by means of handwheels 87 and 87' respectively. On the other hand, rotation of handwheel 87' drives, through a double right- and left-hand arrangement of lead screw-nut screw, the mutual approaching of the two tongs and of the outer belts of conveyor belt 65, whereby the tongs are brought to clamp tubular crowns 58 as close as possible to container 2. It is very important that both tongs operate as close as possible to container 2; otherwise, besides the unavoidable film waste, the packaged container appearance would be poor, and the excess film might result in possible wrapping damage thereafter, during packaged container transportation. Upper levers 76, 76' carry, at the ends thereof, also clamps 83, 83' and sealing devices 89, 89' provided with blades 90, 90', while lower levers 79, 79' carry at the ends thereof clamps 82, 82' and sealing devices 91, 91' having no blades.

In FIG. 11 there is also shown, under different angles, all of the other parts already described above referring to FIG. 10. This concerns in particular the motor driven rollers 81, 81' and the sealing devices 91, 91', whose operation will be described in the following referring to FIGS. 12 to 14.

Figure 12:
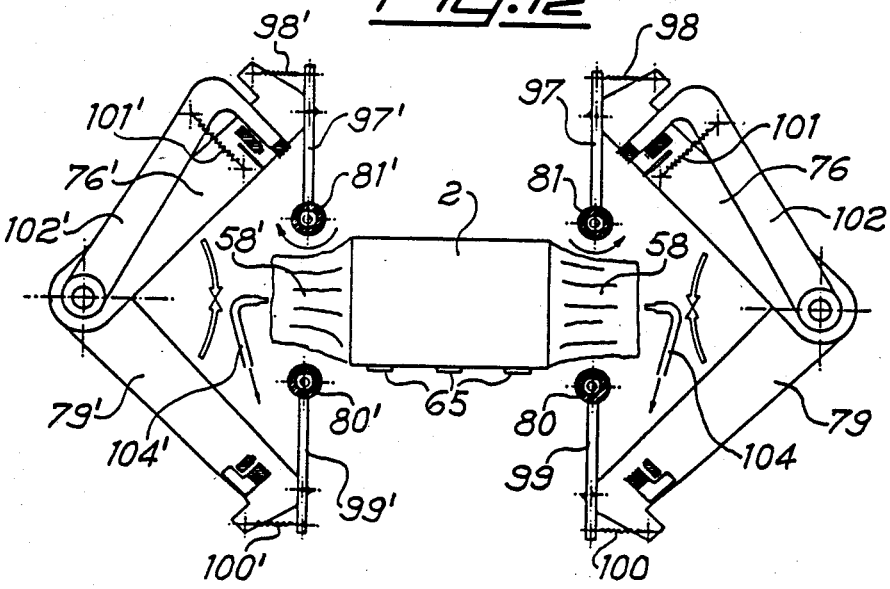
FIGS. 12 to 14 are detailed views of the transverse stretch devices and film sealing devices during the complete packaging operations of the articles.

In FIG. 12 there is shown container 2 with tubular crowns 58, 58' which are in the process of being clamped between pairs of rollers 80, 81 and 80', 81' respectively, following mutual approaching motion of levers 76, 79, and 76', 79', according to the direction indicated by the two pairs of arrows shown in the Figure. Motor driven rubber lined rollers 81, 81' rotate in the direction indicated by the small arrows shown by them, while idle rollers 80, 80' are yet at standstill.

Figure 13:
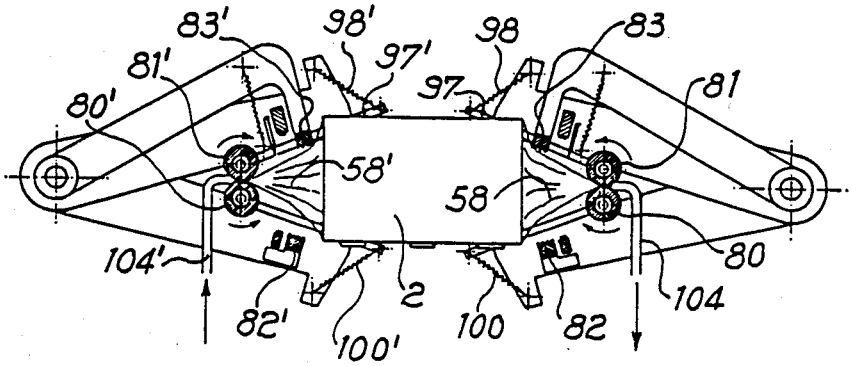

In FIG. 13 there is shown that the pairs rollers 80, 81, and 80', 81' have already clamped crowns 58 and 58' respectively, and pull them sideways due to the counter-rotation induced on idle rollers 80, 80' by motor driven rollers 81, 81'. Pressure of roller 81 against roller 80 is ensured by lever 97 under the action of spring 98. Lever 99 and spring 100, in turn, are pushing roller 80 against roller 81. Similarly the pressure between rollers 80' and 81' is maintained by levers 97', 99' and by springs 98', 100'. At this stage of operation, clamps 82, 83 and 82', 83' are not yet engaged against crowns 58, 58', whereby the latter are free to be transversely stretched under the pull of the pairs of rollers 80, 81 and 80', 81'.

Figure 14:
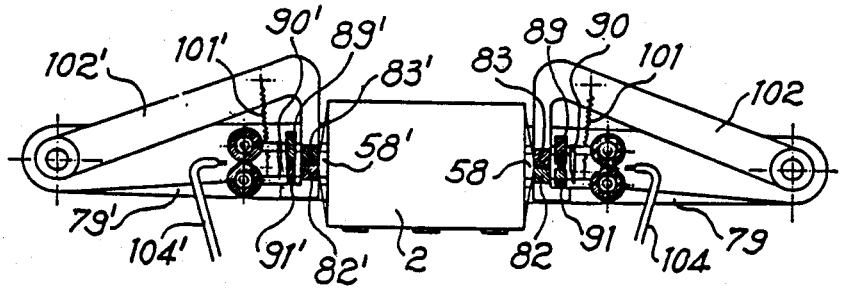

In FIG. 14 there is shown that levers 76, 79 and 76', 79' have reached the terminal clamping position. The pairs of clamps 82, 83 and 83', 83' have locked film crowns 58, 58' respectively, previously stretched by the rubber lined rollers, and they operate so that film tension on package 2 cannot be relaxed. Pressure between the pairs of clamps 82, 83 and 82', 83' is maintained by springs 101, 101' tensioned between levers 76, 102 and between levers 76', 102' respectively. Blade 90 mounted on upper sealing device 89 has already severed the film in the span of crown 58 found in tension between clamps 82, 83 and rollers 80, 81. The same operation has been performed simultaneously by corresponding blade 90' which has severed crown 58' on the left hand side in the Figure.

The excess film of crown 58 on the right of blade 90 which has already been severed from the remaining film is ejected by the counter-rotating action of rollers 80, 81. The same operation is performed simultaneously by the left hand side rollers 80', 81' which eject the waste film remaining on the left of blade 90'. At this point, the mutually facing metal strap resistances of sealing devices 89 and 91 receive a current pulse and perform the sealing closure of crown 58. Similarly, sealing devices 89' and 91' perform sealing on the opposite side of container 2, in order to close crown 58'. In this way, container 2 gets eventually covered completely, on all the faces thereof, by film 20, which encloses it tightly due to its elastic memory.

At the end of the sealing operation, the pairs of levers 76, 79 and 76', 79' open up slightly whereby sealing devices 89, 91 and 89', 91' do not put further pressure on the film. Clamps 82, 83 and 82', 83' keep locking and tensioning the film around container 2 through the action of springs 101, 101' still tensioned. In order to improve the grip of clamps 82, 83 and 82', 83' on the film, the face of each clamp coming into engagement with the film is preferably comprised of knurled metal on one edge and soft rubber on the opposite edge. Said clamps continuously maintain film 20 locked and tensioned against container 2 during the whole sealing bead cooling time. Cooling is performed by means of compressed air jets directed against the sealing bead through small nozzles machined on sealing devices 89, 91, and 89', 91', which have a hollow structure thoroughly similar to that of sealing devices 36, 37 of the first machine station, as already described above. Once cooling has been completed, levers 76, 79 and 76', 79' open up completely and belts 65 can transfer completely packaged container 2 onto roller table 103, sloping downwards, wherefrom it is unloaded. Simultaneously, belts 65 carry into position for complete sealing, container 2' coming from the bundling operation, whose tubular film crowns have yet to be stretched, sealed and severed.

The whole machine according to this invention is preferably controlled by a central computer having in storage memory a plurality of programs whereby it is able to change the stroke amplitudes, pulling forces, operating speeds, and acceleration ramps of each individual motor of said machine. This guarantees the phases of interconnection of motions and at the same time provides the machine with enough flexibility to enable said machine to bundle or to package completely a plurality of different types and forms of articles, both loose and collected in containers using films having variable properties, without requiring special provisions besides the normal mechanical adjustments. The computer controls as well the pulling force on the stretching device rollers in the first machine unit, as well as of the rollers provided to stretch the container tubular crowns in the second unit, according to the more or less resilient type of film used.

The embodiment described and shown in the attached drawings has been reported for exemplary purposes only, with no meaning of limitation of this invention. Those skilled in the art can make additions and/or modifications thereto, within the scope of this invention.

What is claimed is:

1. A machine for packaging one or more articles within a stretchable plastic film, the articles either alone or when bundled together having an outer profile which is substantially parallelepipedal, said machine comprising:

(a) stretching means for longitudinally stretching a segment of film web before wrapping the segment around the articles to be packaged;

(b) feeding means disposed in film feeding association with said stretching means for feeding the segment of film web to said stretching means;

(c) horizontal forwarding means for forwarding the articles to be packaged toward said stretching means, said horizontal forwarding means being located at a lower vertical height relative to said stretching means, said horizontal forwarding means comprising one or more conveyor belts;

(d) vertical forwarding means for lifting the articles to be packaged toward said stretching means, said vertical forwarding means being located beneath said stretching means and being in article receiving relationship to said horizontal forwarding means when said vertical forwarding means is in a lowered position, said vertical forwarding means comprising two half series of rollers, each said half series of rollers being configured so that they may be brought together to form an article support plane in cooperative alignment with the one or more conveyor belts of said horizontal forwarding means for receiving articles therefrom, said vertical forwarding means further comprising a motor, the motor being operatively attached to each of the half series of rollers for raising and lowering the half series of rollers;

(e) means for wrapping the stretched segment of film web longitudinally around the top, side and bottom of the articles;

(f) sealing means for sealing the segment of film web after the segment has been stretched and wrapped around the articles and while the segment is still under tension, said sealing means including two roller tables; and (g) means associated with said sealing means for displacing each of the half-series of rollers of the vertical forwarding means while moving the roller tables towards one another and under the articles undergoing wrapping with the segment of film web being simultaneously positioned between the roller tables and the articles and maintained in tension prior to sealing.

2. The machine according to claim 1, further comprising two pairs of parallel chains (54, 54'' and 54', 54''') and two sets of three idle chain sprockets (55, 56, 57 and 55', 56' and 57') and wherein the rollers (12) of each said half series of rollers have ends, the ends of the rollers of each half series being respectively connected to the two pairs of parallel chains (54, 54'', and 54', 54''') the two pairs of parallel chains being rotatable around the three idle chain sprockets (55, 56, 57, or 55', 56' and 57'), respectively.

3. The machine according to claim 2, wherein the idle sprockets 55, 56, 57 and 55', 56' and 57') are respectively located at the corners of an imaginary inverted triangle whereby the sum of the top sides or bases of said triangles form a side of the article support plane for the articles to be packaged.

4. The machine according to claim 2, wherein said vertical forwarding means includes a small diameter roller (112) positioned between the two half series of rollers (12) of the article support plane when the articles to be packaged reach said article support plane, the small diameter roller (112) being independently supported by said vertical forwarding means in an article supporting position to thereby remain in article supporting relation with the article being wrapped until said position is taken by the displacing means.

5. The machine according to claim 1, wherein the feeding means includes a first roll (21) wherefrom the film web unwinds, and a second roll (22) whereon the film web is rewound after completion of sealing and severing operations of the film web segment that has been wrapped around the articles to be packaged, said feeding means further including positioning means positioned between said rolls for predetermining the length of the film web segment to be rewound around said second roll (22).

6. The machine according to claim 5, wherein the positioning means comprises a motor (33) and a rubber lined roller (32) which rubber lined roller is operatively connected to motor (33) to be driven thereby and which rubber lined roller is positioned in supporting relation to said second roll (22) to thereby rotate the second roll (22) through the angle needed to rewind the predetermined length of web of film (20) onto said second roll (22).

7. The machine according to claim 6, further comprising means for controlling the rotation of rubber lined roller (32) and of second roll (22) so that the rotation of second roll 22 may optionally (i) cover a predetermined maximum angle when it is desired that on the film peripherally wrapped around the packaged articles there shows a single sealing seam on the bottom side of said articles, (ii) cover a zero amplitude angle when it is desired that on said film there shows two sealing seams at diametrically opposite positions, or (iii) cover increasing intermediate angles corresponding to positions of the second sealing seam closer and closer to the first sealing seam located at the bottom side of the packaged articles.

8. A machine for packaging one or more articles within a stretchable plastic film, which articles either alone or when bundled together have an outer profile which is substantially parallelepipedal, said machine comprising:

(a) stretching means for longitudinally stretching a segment of film web before wrapping the stretched segment of film web around the articles to be packaged, said stretching means comprising means for providing and maintaining a substantially predetermined uniform tension force to the segment of film web, the tension being sufficient to cause longitudinal stretching of the segment of film web;

(b) vertical forwarding means for lifting the articles to be packaged into the stretched segment of film web, said vertical forwarding means being located beneath said stretching means, the vertical forwarding means including a support plane (12); segment of film web peripherally around the articles without substantially altering the predetermined uniform tension force on the segment of film web prior to sealing, wherein the wrapping means comprises means for wrapping the stretched segment of film web around the articles to be packaged by pushing said stretched segment of film web underneath said articles to be packaged and providing an article support plane while continuously keeping the stretched segment of film web under tension against the upper surface of the article to be packaged, the wrapping means further comprises two folding devices (35, 35') and means for moving the folding devices mutually closer under the action of a motor (38) while pushing the segment of film (20) underneath the article to be packaged, and displacing the support plane (12) of said articles eventually replacing the same with the two folding devices associated with said wrapping means; and (d) sealing means for sealing the stretched segment of film web after the stretched segment of film web has been wrapped peripherally around the article and while the stretched segment of film web is still under said predetermined tension, said sealing means being operatively associated with said wrapping means for maintaining the predetermined tension on the film web during wrapping.

9. The machine according to claim 8, wherein the stretching means comprises two pairs of rollers (27, 27' and 28, 29') the rollers in each pair of rollers being operatively disposed in close proximity to one another to clamp and retain ends of the segment of film web (20) along two lines at right angles to longitudinal edges of the segment of film web.

10. The machine according to claim 8, wherein the wrapping means further includes means for inserting an object between the film and the articles to be packaged, while wrapping said articles for maintaining the predetermined uniform tension force on the film while said articles are lifted into the stretched film segment.

11. A machine according to claim 10, wherein said means for inserting an object between the film and the articles to be packaged comprises two tension members (19, 19') each tension member having a horizontal arm which is shaped to engage directly against the film, in a direction at right angles with the longitudinal edges of the web of film (20), the length of the tension means being shorter than the width of the web of film (20).

12. The machine according to claim 8, wherein the sealing means comprises means for joining by electric pulse sealing the web segment areas of film (20) previously brought into mutual contact underneath the articles to be packaged by said wrapping means, while the film segment is still tensioned around said articles.

13. The machine according to claim 12, wherein said sealing means includes a pair of electric metal strap sealing devices (36, 37) which are configured to transversely seal the mutually contacting web segment areas of film (20) along the line at right angles with the longitudinal edges of said film web.

14. The machine according to claim 13, wherein said sealing means includes a blade (61) adapted to sever the sealing area along a median line at right angles with the longitudinal edges of the web of film (20).

15. The machine according to claim 8, further comprising transverse wrapping means for transversely stretching the film web peripherally wrapped around the articles to be packaged, and transverse sealing means for completely sealing the package.

16. The machine according to claim 15, wherein said transverse wrapping means includes gripping means for gripping and transversely stretching two crowns of film (58, 58') protruding out of the opposite sides of the articles tightly enclosed by the segment of film web (20) after the articles have been peripherally wrapped and sealed therearound in the longitudinal direction.

17. The machine according to claim 16, wherein said gripping means comprises two pairs of rubber lined rollers (80, 81 and 80', 81'), both rollers of each pair being operatively connected for counter-rotating when one of the film crowns (58, 58') is inserted therebetween.

18. The machine according to claim 17, wherein said gripping means further comprises shafts (85 and 85') and two pairs of levers (76, 79 and 76', 79') each pair of levers being pivoted, respectively, on shafts (85, 85'), the rollers in each said pair of rubber lined rollers thereby being able to mutually approach or move away from each other, said gripping means further comprising two motors and two pairs of cams (75, 78 and 75', 78'), each said pair of cams being associated with one of said motors, each said pair of cams being operatively connected to a respective pair of said levers for driving same.

19. The machine according to claim 15, wherein the transverse sealing means comprises pairs of levers (76, 79 and 76', 79') and two pairs of electric pulse sealing devices (89, 91 and 89', 91') for forming a sealing bead, the pairs of electric pulse sealing devices being respectively mounted at the ends of said pairs of levers (76, 79 and 76', 79'), the upper sealing devices (89, 89') being provided with a blade (90, 90') the blade being configured to cut the excess film outside the sealing bead.

20. The machine according to claim 19, further including two handwheels (87, 87') which are operatively connected through suitable means to the shafts (85, 85') of said pairs of levers at the centerline level of the articles to be packaged for positioning the shafts (85, 85').

21. The machine according to claim 20, further including a handwheel (87'') which is operatively connected through suitable means, to the two pairs of rubber lined rollers (80, 81 and 80', 81') for causing the two pairs of rubber lined rollers to engage against film tubular crowns (58, 58') as close as possible to the articles to be packaged.

22. The machine according to claim 8, wherein the wrapping means further comprises two roller tables (59, 59').

* * * * *